United States Patent [19]

Lamarque

[11] 4,047,555

[45] Sept. 13, 1977

[54] METHOD OF AND APPARATUS FOR POSITIONING CONSUMABLE ELECTRODES IN AN ELECTROSLAG REMELTING BATH

[75] Inventor: Gabriel Lamarque, Paris, France

[73] Assignee: Vereinigte Edelstahlwerke AG. (VEW), Vienna, Austria

[21] Appl. No.: 725,568

[22] Filed: Sept. 22, 1976

[30] Foreign Application Priority Data

Sept. 23, 1975 France ..... 75.29081

[51] Int. Cl.[2] ..... B22D 45/00

[52] U.S. Cl. ..... 164/52; 164/252; 13/14; 75/10 C; 214/1 BC

[58] Field of Search ..... 164/52, 252, 1; 219/138, 139, 144; 13/14, 15, 16; 75/10 C; 214/1 BB, 1 BC, 151, 653

[56] References Cited

U.S. PATENT DOCUMENTS

| | | | |
|---|---|---|---|
| 1,811,832 | 6/1931 | Moyers | 214/1 BC |
| 3,660,584 | 5/1972 | Holzgruber et al. | 13/14 |
| 3,739,066 | 6/1973 | Ermold et al. | 13/14 X |
| 3,806,622 | 4/1974 | Marchner | 13/14 |

*Primary Examiner*—Ronald J. Shore

[57] ABSTRACT

Consumable electrodes are transferred to and from an operative position in an underlying melting bath by means of a pair of lifts that are vertically movable on masts located on opposite sides of the mold axis. One of the lifts has a fixed portion extending transversely through the axis and toward the other lift, and has a recess aligned with the mold axis and with the path of oscillation of an electrode-transferring arm carried by the other lift. When an electrode is transferred into the recess, a collar on the electrode is clamped to the upper surface of the fixed portion, whereupon the first lift is moved downwardly to position the inserted electrode into the mold. Consumed electrodes are removed by raising the first lift, and engaging a lifting collar on the upper end of the residual portion of the electrode by an arm that is carried for vertical movement and oscillation by the first lift. After such additional arm is oscillated away from the recess with the consumed electrode, the arm on the second lift can be actuated to transfer a new electrode into the recess.

7 Claims, 3 Drawing Figures

METHOD OF AND APPARATUS FOR POSITIONING CONSUMABLE ELECTRODES IN AN ELECTROSLAG REMELTING BATH

BACKGROUND OF THE INVENTION

The invention relates to techniques for positioning a consumable electrode in and out of an electroslag remelting bath.

In electroslag remelting processes, a consumable electrode is conventionally lowered progressively by a holding member in to a melting bath or mold, which in turn is supported along a first vertical axis; for this purpose, an integral collar on the upper portion of the consumable electrode is engaged by the holding member. After the electrode has been consumed during the remelting operation, the residual, unconsumed stem of the electrode is lifted out of the bath to be suitably removed from the holding member.

A problem of this arrangement is that of accurately and inexpensively transferring a succession of new electrodes from a supply location to the holding member prior to the lowering of the electrodes into the bath, and of emptying the holding member of the residual stems in preparation of the receipt of a new electrode.

SUMMARY OF THE INVENTION

The present invention provides a method and apparatus for transferring consumable electrodes of the above-mentioned type into position for vertical movement toward and away from the melting bath positioned on a first vertical axis. In an illustrative embodiment, a pair of vertical masts are disposed along second and third axes, respectively, on generally opposite sides of the first axis. A first lift is mounted for reciprocation along the first mast, such first lift having a fixed electrode-receiving portion which extends generally transversely across the first axis and toward the second mast. A second lift is independently supported for reciprocation on the second mast, such second lift carrying a pivotal arm adapted to receive successive new electrodes from a suitable supply and for transferring them, via an oscillation of such arm, to a recess disposed in the fixed portion of the first lift and centered on the first axis.

A clamping arrangement associated with the upper surface of such fixed portion is operable to press the collar of the transferred new electrode against the upper surface of the fixed portion after such collar has been lowered into superposed relation with such upper surface by the first arm. At this time, the first lift can be lowered to bring the so-captured new electrode into the underlying remelting bath.

When such electrode becomes consumed, the first lift is raised, whereupon a second pivotal arm supported for vertical movement and oscillation on the first lift is swung toward the recess to capture the residual electrode stem by means of a lifting ring disposed on top of such stem above the collar. For this purpose, such second arm has a forkshaped hook on the outer end thereof, such hook being adapted to engage the lower surface of the lifting ring when the second arm is moved up with respect to the first lift. Upon engagement of the hook with the lifting ring, the second arm may then be swung back from the first axis to expose the recess in the first portion of the first lift to the first arm on the second lift to receive a new electrode.

Advantageously, the electroslag remelting bath or mold itself may be transferred to and from its operative position along the first axis by means of a third pivotal arm supported on a third lift, which is mounted for reciprocation below and independent of the second lift.

BRIEF DESCRIPTION OF THE DRAWING

The invention is further set forth in the following detailed description taken in conjunction with the appended drawing, in which.

DETAILED DESCRIPTION

Figure 1:
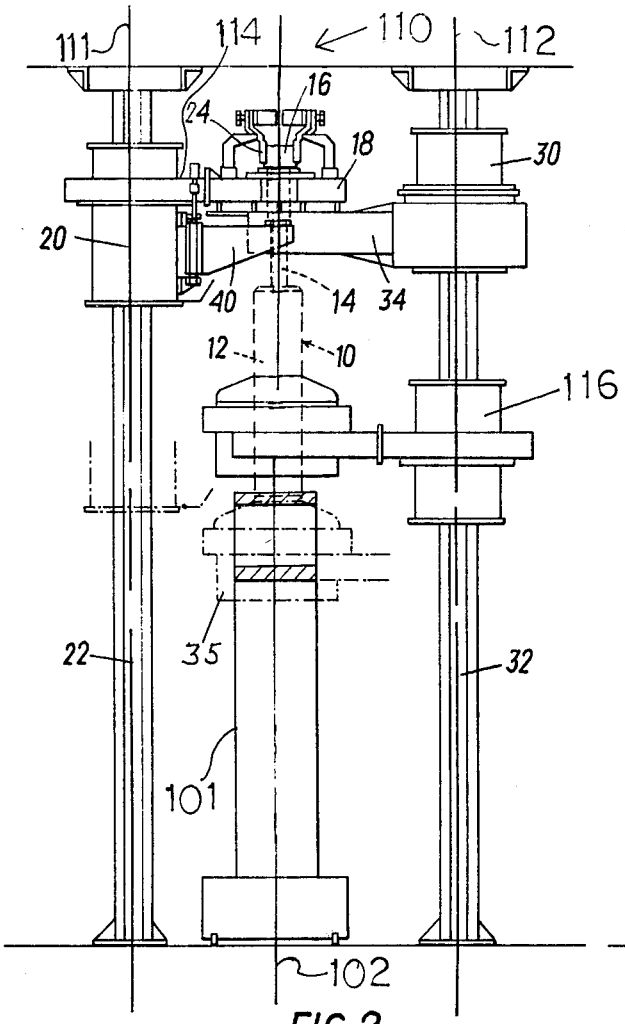
FIG. 1 is an elevation view of an arrangement in accordance with the invention for transferring consumable electrodes toward and away from a position in superposed relation to an electroslag remelting bath.

Referring now to the drawing, the numeral 35 generally represents a liquid-cooled mold section of conventional design for use in an electroslag remelting process. In its operative position shown in dotted lines in FIG. 1, the mold section 35 is positioned on a support 101 along a first vertical axis 102, such mold section being moved into operative position in the manner described below.

The mold section 35 is adapted to receive a consumable electrode 10, which in its original form is lowered into the mold section 35 along the axis 102. In operation, the progress of the electroslag remelting operation progressively consumes the electrode 10, and such electrode is successively lowered by increments into the mold section 35 to compensate for such consumption. When the electrode is completely consumed (e.g., when a main lower section 12 thereof has been used up in the process), the remainder of the electrode, represented by an upper, reduced diameter stem portion 14, is lifted up out of the mold section 35 to be replaced by a new electrode 10.

In accordance with the invention, an electrode transfer mechanism, designated generally at 110, is provided for transferring electrodes 10 to and from the mold section 35.

Illustratively, the mechanism 110 includes a pair of masts 22, 32 individually extending along vertical axes 111, 112 disposed on generally opposite sides of the mold axis 102. A first lift 20 is mounted for reciprocation along the mast 22, and has secured thereto a first transversely extending portion 18 for receiving an electrode 10 to be transferred.

Figure 2:
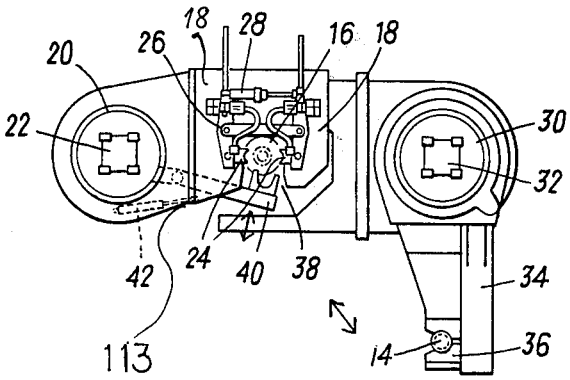
FIG. 2 is a plan view of the arrangement of FIG. 1.

As shown best in FIG. 2, the portion 18 extends across the main mold axis 102 and toward the mast 32. The portion 18 is provided with a recess 38 cut into a side surface 113 thereof, a portion of such recess being vertically aligned with the mold axis 102. The recess is so constructed as to receive the stem portion 14 of an electrode 10 from an electrode-carrying arm 34. The arm 34 is supported for pivotal movement on a second lift 30 mounted for vertical reciprocation on the mast 32.

In particular, the arm 34 includes an electrode gripping portion 36, which is adapted to engage an integral collar 16 of a new electrode 10 from a suitable storage position (not shown) in the vicinity of the mechanism 110. The path of oscillation of the arm 34 extends from an electrode receiving position shown in FIG. 2 to an electrode discharging position along the mold axis 102, wherein the arm 34 places the stem of the electrode 10 into the recess 38 of the fixed portion 18. To effectuate such operation, the lift 30 is positioned at a higher elevation than the lift 20, so that the collar 16 of the electrode gripped by the arm 34 is disposed above an upper surface 114 of the fixed portion 18.

A pair of opposed clamping jaws 24 are supported on the upper surface 114 of the fixed portion 18 for gripping the collar 16 of the just-transferred electrode 10 after the collar 16 has been lowered into engagement with the upper surface 114, e.g., by lowering the lift 30. The jaws 24 are operable in a conventional manner via a hydraulic cylinder 28 (FIG. 2).

After the arm 34 is pivoted back into its rest position away from the mold axis 102, the so-gripped electrode 10 can then be lowered into the interior of the underlying mold section 35 by lowering the associated lift 20.

After the main portion 12 of the electrode has been consumed, the remaining stem 14 can be lifted up out of the mold section 35 by suitably raising the associated lift 20. In order to remove the stem of the consumed electrode from the recess 38 so that a new electrode can be positioned therein by the arm 34, the lift 20 is further provided with an arm 40 which is movable vertically with respect to the lift 20 and which is mounted for oscillation, with respect to the fixed portion 18, along a path which extends into the recess 38 aligned with the mold axis 102. A hydraulic cylinder 42 is supported on the lift 20 for movement from an electrode-engaging position within the recess 38 to a withdrawn position, at which the removed stem can be discharged from the mechanism 110 by conventional means.

A generally fork-shaped hook member 44 extends from the outer end of the arm 40, the member 44 being adapted to engage the lower surface of a lifting ring 46 (FIG. 3) on the upper end of the electrode stem 14 when the arm 40 is in its raised position on the lift 20 and oscillated into the recess 38.

In the operation of the arrangement thusfar described, the lift 30 is initially positioned on the mast 32 so that, in the position shown in FIG. 2, the portion 36 of the electrode-engaging arm 34 comes into contact with an appropriate portion (e.g., the collar 16) of the stem 14 on a new electrode in the non-illustrated supply location. The lift 30 is then raised to a position above the level of the lift 20 on the mast 22, and the arm 34 is swung in a clockwise direction as viewed in FIG. 2 until the stem 14 of the electrode enters the recess 38 in the fixed portion 18.

The lift 30 is then lowered until the collar 16 comes into engagement with the top surface 114 of the fixed member 18, after which the arm 34 releases the electrode and swings back into its rest position.

The hydraulic cylinder 28 is then actuated to clamp the jaws 24 securely on the collar 16, after which the lift 20 is lowered to bring the main portion 12 of the electrode into operative position within the mold section 35.

Figure 3:
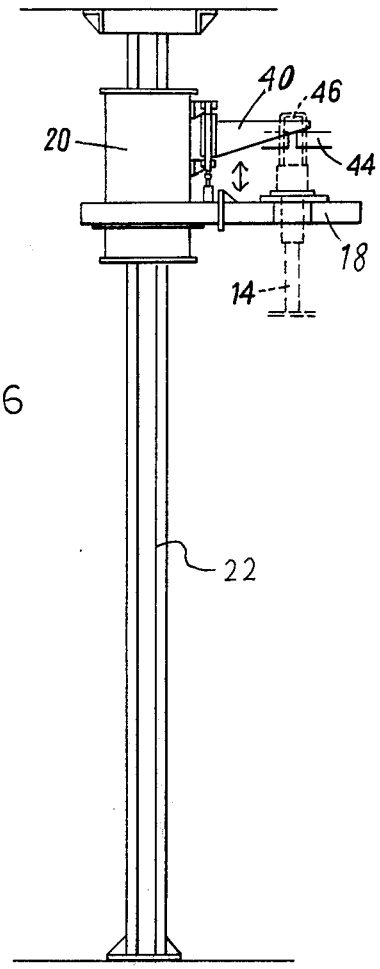
FIG. 3 is an elevation view of a portion of the system of FIG. 1, such portion having facilities for removing residual electrode stems after consumption in the remelting bath.

After the main portion 12 of the electrode has been consumed, the remaining stem 14 is removed from the mold by raising the lift 20 into the position shown in FIG. 3. In such exposed position, the pivotal arm 40 is moved into an upper position, with the fork-shaped hook member 44 in alignment with the lifting ring 46 on the electrode stem 14. The arm 40 is then pivoted into the recess 38 to engage the lifting ring 46, after which the arm 40 is swung back out of the recess to discharge the stem. At this point, the fixed portion 18 is again ready to receive a new electrode 10 from the arm 34 on the lift 30.

Advantageously, the mold section 35 itself can be transferred to and from the operative position shown along the mold axis 102 by an arrangement similar to the lift 30 and the pivotal arm 34. In particular, the section 35 may be transferred to and from the mold axis by means of a lift 116 which is supported for reciprocation on the mast 32 below and independent of the lift 30. For this purpose, a mold-transfer arm 34', which may have a construction generally similar to the arm 34 but adapted to receive the mold section 35, is supported for oscillation on the lift 116. With such arrangement, once the arm 34' transfers the mold section 35 to a position on the mold axis 102 as shown in solid lines in FIG. 1, the lift 116 may be lowered to position the section 35 into its operative position shown in dotted lines in the figure.

In the foregoing, an illustrative arrangement of the invention and technique for employing it have been described. Many variations and modifications will now occur to those skilled in the art. It is accordingly desired that the scope of the appended claims not be limited to the specific disclosure herein contained.

What is claimed is:

1. In an arrangement for transferring a consumable electrode to and from an underlying mold section positionable along a first vertical axis, first and second vertical masts disposed in spaced relation on generally opposite sides of the first axis and individually extending along second and third axes, first and second lift means respectively mounted for reciprocation on the first and second masts, the first lift means having a fixed portion extending generally transversely across the first axis toward the second mast, the fixed portion having a recess therein aligned with the first axis for receiving an electrode to be lowered into the mold and thereafter raised after consumption via a reciprocation of the first lift means, and a first electrode-transferring arm supported for oscillation on the second lift means toward and away from the first axis and cooperable with the recess in the fixed portion of the first lift means for selectively positioning an electrode in the recess.

2. An arrangement as defined in claim 1, in which the electrode has an integral collar thereon and in which the first lift means further comprises clamping means disposed on the fixed portion and selectively operable for releasably securing the collar of the deposited unused electrode to the upper surface of the fixed portion.

3. An arrangement as defined in claim 2, further comprising a second electrode-transferring arm supported on the first lift means for vertical movement with respect thereto and for oscillation toward and away from the recess in the fixed portion for engaging and removing a consumed electrode from the recess.

4. An arrangement as defined in claim 3, in which the electrode has a lifting ring integral therewith on the upper end thereof, and in which the first lift means further comprises hook means affixed to an outer end of the second arm for engaging the lower surface of the lifting ring of the consumed electrode.

5. An arrangement as defined in claim 1, further comprising third lift means mounted for reciprocation on the second mast below and independent of the second lift means, and a mold-transferring arm supported for oscillation on the third lift means toward and away from the first axis for positioning a mold section on the first axis.

6. In a method of vertically transferring an elongated consumable electrode having an integral collar thereon to an underlying mold section disposed on a a first vertical axis, the steps of releasably supporting an electrode to be transferred on a first arm which is movable along a second axis spaced from the first axis and oscillatable between the second axis and the first axis; separately supporting an electrode holder in vertically movable relation along a third vertical axis disposed on the opposite side of the first axis, the holder extending in horizontal intersecting relation to the first axis and having a recess aligned with the first axis in the path of oscillation of the first arm; moving the first arm vertically on the second axis until the collar of the engaged electrode is above the upper surface of the electrode holder; oscillating the first arm toward the first axis to position the electrode in the recess of the holder; lowering the first arm along the second axis until the collar abuts the upper surface of the holder and to disengage the electrode from the first arm; oscillating the now-empty first arm away from the first axis; and lowering the holder along the third axis to position the electrode engaged in the recess within the underlying mold section.

7. A method as defined in claim 6, in which the electrode has a lifting ring on the upper end thereof, and in which the method further comprises the steps of supporting a second arm for vertical and oscillatory movement on the electrode holder, the path of oscillation of the second arm being toward and away from the recess inthe holder; lifting the holder along the third axis to withdraw the consumed electrode from the mold along the first axis; raising the second arm with respect to the holder to align the second arm with the lifting ring on the consumed electrode; oscillating the second arm into the recess on the first axis to engage the lifting ring on the consumed electrode; and oscillating the second arm and the electrode engaged thereby away from the first axis.

* * * * *